United States Patent [19]

Fajfr

[11] 4,105,053

[45] Aug. 8, 1978

[54] NOZZLE ASSEMBLY FOR A HYDRAULIC JET LOOM

[75] Inventor: Václav Fajfr, Tyniste nad Orlici, Czechoslovakia

[73] Assignee: ELITEX, koncern textilniho strojirenstvi, Liberec, Czechoslovakia

[21] Appl. No.: 819,575

[22] Filed: Jul. 27, 1977

Related U.S. Application Data

[63] Continuation-in-part of Ser. No. 716,599, Aug. 23, 1976, abandoned.

[30] Foreign Application Priority Data

Oct. 2, 1975 [CS] Czechoslovakia ..... 6664/75

[51] Int. Cl.[2] ..... D03D 47/32

[52] U.S. Cl. ..... 139/435

[58] Field of Search ..... 139/435; 226/97

[56] References Cited

U.S. PATENT DOCUMENTS

| | | | |
|---|---|---|---|
| 2,855,959 | 10/1958 | Suaty et al. | 139/435 |
| 2,998,029 | 8/1961 | Zahradnils | 139/435 |
| 3,633,808 | 1/1972 | Suaty | 139/435 |

FOREIGN PATENT DOCUMENTS

| | | | |
|---|---|---|---|
| 2,267,405 | 4/1974 | France | 139/436 |

*Primary Examiner*—Henry S. Jaudon

[57] ABSTRACT

An improved nozzle arrangement having facilities for reducing turbulence in the flow of hydraulic pressure pulses during the introduction of a weft-propelling fluid to a pressure chamber of such arrangement is described. An annular insert is disposed coaxially within the outer nozzle housing exhibiting a liquid-introducing radial opening, the insert having a peripheral recess in alignment with the radial opening in the housing. A plurality of axial bores are disposed symmetrically around the circumference of the insert, and extend forwardly from the front wall of the peripheral groove to communicate with the pressure chamber defined between the front wall of the insert and the front flange of a nozzle member, such nozzle member having a central tubular element extending rearwardly from the flange and into the hollow interior of the insert. The propelling fluid is loaded into the pressure chamber via the radial opening, the peripheral groove and the axial bores, and communicates with the weft-propelling interior of the nozzle via an intermittently opened resiliently biased reciprocable valve element.

5 Claims, 3 Drawing Figures

NOZZLE ASSEMBLY FOR A HYDRAULIC JET LOOM

This application is a continuation in-part of application Ser. No. 716,599, filed Aug. 23, 1976, now abandoned.

BACKGROUND OF THE INVENTION

The invention relates to nozzle assemblies for hydraulic jet looms, and more particularly to nozzle assemblies of this type wherein a weft-propelling fluid injected radially into the assembly via a radial opening in the outer nozzle housing is loaded into a pressure chamber in intermittent communication with a weft-receiving central region of the nozzle.

In existing nozzle assemblies of this type, it is customary to locate the radial opening in the outer nozzle housing so that the inner end of such opening is in direct communication with a pressure chamber, which is bounded on one side by the front flange of the nozzle member proper. As a result, the weft-propelling liquid introduced into the assembly via the radial opening flows directly into the pressure chamber.

A disadvantage of such arrangement is that the direct loading of the pressure chamber in this manner causes liquid to flow around two sides of a tubular portion of the nozzle element extending rearwardly from the front flange, leading to perturbations in the rate of filling of the chamber and thereby to a turbulent flow of the pressure pulses of such fluid between the inlet port of the assembly and the pressure chamber. Such turbulent flow has been found to adversely affect the properties of the liquid flowing out of the nozzle during the weft insertion operation, thereby degrading the weft insertion operation particularly when weaving at high speeds or with yarns having high denier numbers.

SUMMARY OF THE INVENTION

Such disadvantages are overcome with the improved nozzle assembly of the invention. In an illustrative embodiment, an annular insert is positioned within the cylindrical outer housing of the assembly, the insert having a peripheral groove oriented perpendicular to the axis of the assembly. The peripheral groove is in alignment with and abuts the inner end of the radial opening in the cylindrical housing, the peripheral groove having a width at least as great as the diameter of the radial opening.

The insert is axially recessed rearwardly of the front surface of the cylindrical housing so that the pressure chamber is bounded axially by the front surface of the insert and the rear surface of the nozzle member flange. A plurality of axial bores extend through the front end of the insert from the front boundary wall of the periphery groove to communicate with the pressure chamber. Consequently, weft-propelling fluid introduced into the radial opening of the cylindrical housing is indirectly loaded into the pressure chamber, the loading path extending successively through the peripheral groove and the several axial openings in the insert. Such indirect loading has been found to substantially reduce the turbulence of flow of the liquid in the pressure chamber and between the pressure chamber and the central weft-transmitting opening of the nozzle, such opening being disposed radially inward of the pressure chamber and intermittently connected to it via a closable resiliently biased valve.

In order to optimize the reduction of turbulence in the flow associated with the pressure chamber, an even number (at least 4) of axial bores are disposed in the insert, such bores being disposed symmetrically about the axis of the radial opening in the outer cylindrical housing. The sum of the cross-sectional areas of such axial bore is advantageously equal to or less than the cross-sectional area of the radial opening.

In addition, it has been found preferable to make the cross-sectional area of the peripheral groove of the insert at least as great as the cross-sectional area of the radial opening in the surrounding housing.

BRIEF DESCRIPTION OF THE DRAWING

The invention is further set forth in the following detailed description taken in conjunction with the appended drawing, in which.

DETAILED DESCRIPTION

Figure 1:
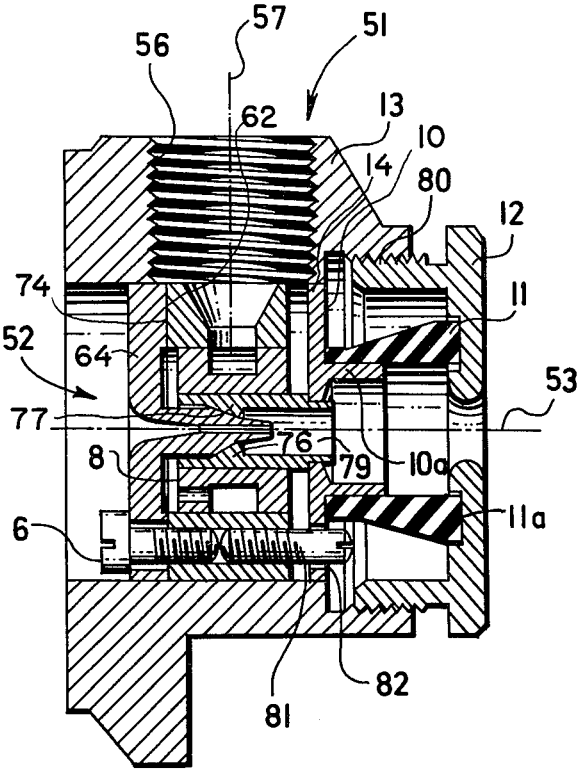
FIG. 1 is a longitudinal view in axial section of an overall nozzle assembly containing facilities in accordance with the invention for reducing turbulent flow of the weft-propelling fluid introduced into the nozzle pressure chamber.
Figure 3:
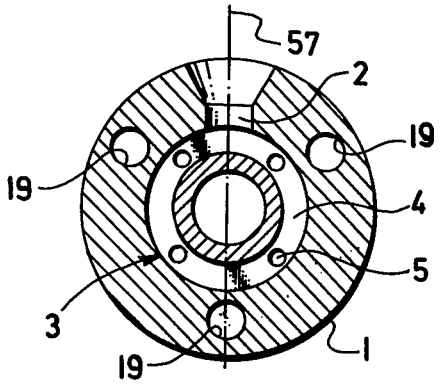
FIG. 3 is a transverse sectional view taken along line 3—3 of FIG. 2, the nozzle element and the sleeve surrounding the nozzle being omitted for clarity of illustration.
Figure 2:
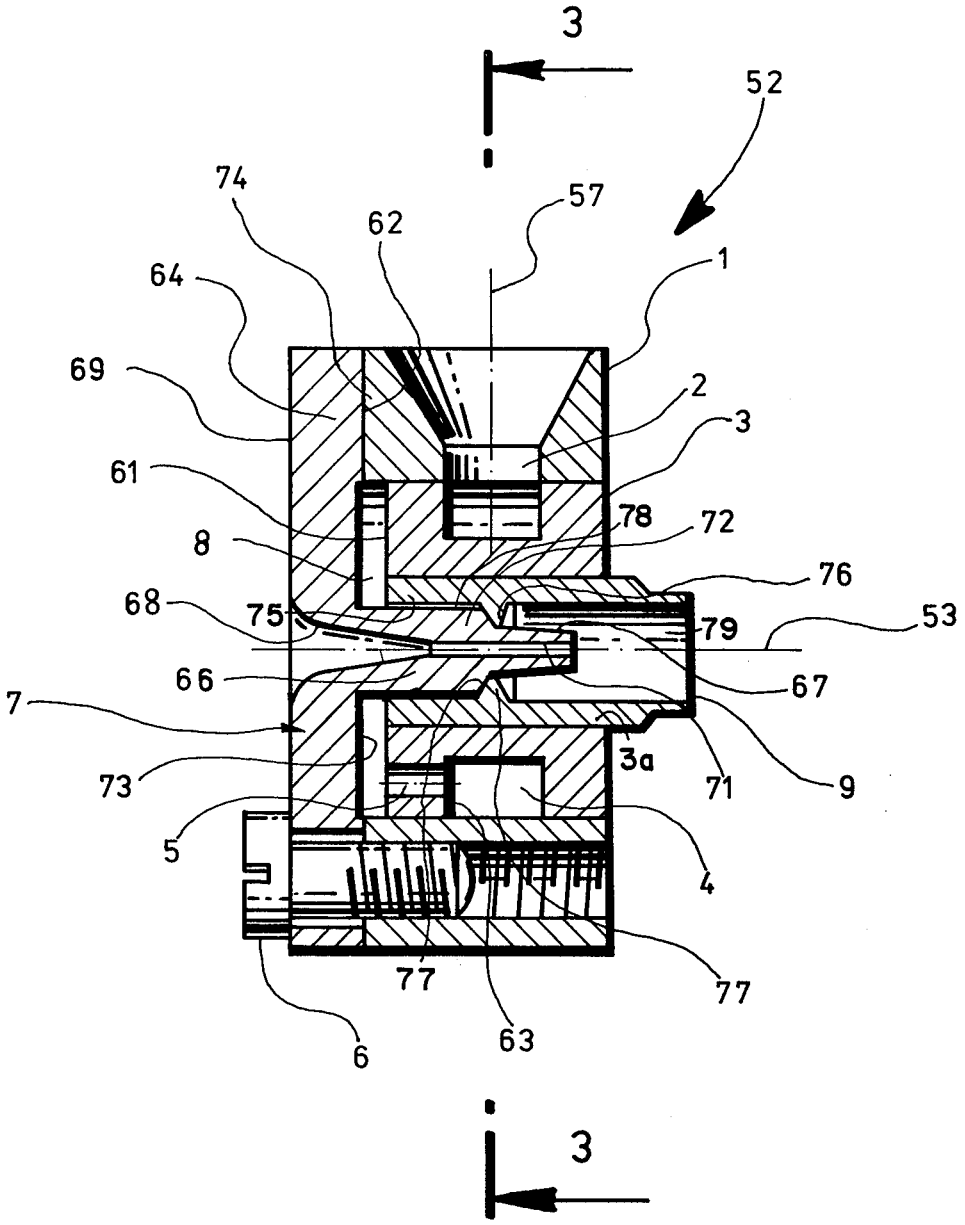
FIG. 2 is a longitudinal view in axial section of the turbulence-reducing facilities of FIG. 1.

Referring now to the drawing, the overall nozzle assembly depicted at 51 includes an outer protective jacket 13 in which there is disposed a sub-assembly 52 constructed in accordance with the invention and illustrated best in connection with FIGS. 2 and 3. The front of the assembly and of the parts thereof is assumed to be at the left extremity as viewed in FIGS. 1 and 2, and the rear of the assembly is assumed to be at the right in such figures. The assembly 51 is adapted for use in a hydraulic loom, particularly for intermittently propelling a weft thread (not shown) along a nozzle axis 53 and into the warp shed of the loom in a conventional manner. The weft-propelling medium in such case is a suitable liquid, which may be introduced into the subassembly 52 through a radial opening 56 extending through the wall of the housing jacket 13, such opening 56 extending along an axis 57 transverse to the central nozzle axis 53.

Referring now to FIGS. 2 and 3, the sub-assembly 52 includes an outer cylindrical housing 1, through which a flared radial opening 2 extends along the axis 57. Disposed coaxially in the housing 1 is an insert 3 constructed in accordance with the invention. Insert 3 is press fitted into housing 1 and its there fixedly held with respect thereto in the position shown.

The insert 3 is an annular member having a front (left end) surface 61 which is spaced rearwardly from a rear surface 73 of the flange 64 of the insert 7. A peripheral groove 4 is disposed on the outer circumferential surface of the insert 3, such surface abutting the inner radial surface of the housing 1.

As indicated in FIG. 2, the peripheral groove 4 is aligned with the inner end of the radial opening 2. As shown, the width of the groove 4 may be coextensive with the diameter of the opening 2, or alternatively may be made greater than such diameter.

A plurality of angularly spaced axial bores 5 (one shown) extend through the front boundary wall 63 of the peripheral groove 4 in insert 3. Advantageously, the number of such axial bores 5 is made equal to 2N where N is an integer at least equal to 2, so that an even number of bores at least equal to 4 are provided. The bores are circumferentially arranged around the insert 3 symmetrically to the axis 57 of the radial opening 2 in the housing 1 and the peripheral groove 4.

The sub-assembly 52 further includes an element 7 having a flange 64 at its front (left) end. The element 7 has a central tubular nozzle 66 extending rearwardly from the flange 64, the nozzle 66 terminating at its rearward (right) end in a reduced-diameter, externally tapered region 67. The element 7 is secured to the housing 1 by a plurality (three disclosed) of machine screws 6 which extend through openings in the flange 64 and are screwed into tapped holes 19 in the housing 1.

A forwardly disposed frusto-conical nozzle opening or passage 68 extends to the right (rearwardly) from the front (left) surface 69 of the flange 64, the opening 68 converging toward the rear and extending to a circular cylindrical rear passage 71 in the nozzle 66. The nozzle 66 includes a circular cylindrical portion 72 intermediate the flange 64 and the rear externally tapered region 67, the portion 72 in the region 67 being connected by a rearwardly converging frusto-conical zone 77 on the nozzle 66. The outer surface of the circular cylindrical portion 72, which is disposed radially outwardly of the rear end of the nozzle opening 68, forms the radially inner wall of an annular pressure chamber 8 of the sub-assembly 52, the radially outer wall of such chamber being formed by the inner circular cylindrical surface of the housing 1.

The chamber 8 extends axially between the front (left) surface 61 of the insert 3 and the rear surface 73 of the flange 64. In order to seal the chamber 8, the flange 64 is provided with annular boss 74 which extends slightly rearwardly of the surface 73, the rear surface of such boss abutting and effecting a seal with the front surface 62 of the housing 1.

With the arrangement so far described, weft-propelling liquid introduced into the radial opening 2 of the housing 1 enters the pressure chamber 8 through the annular groove 4 and the axial bores 5. Because of such indirect loading of the pressure chamber 8 in the symmetrical manner shown in FIG. 3, wherein 4 axial bores 5 are shown, turbulence of the liquid flow in the chamber is avoided.

In order both to increase the velocity and decrease the turbulence of the flow, the total cross-sectional area presented to the fluid flow by the bores 5 is made less than the cross-sectional area of the radial opening 2 in the housing 1. Also, the cross-sectional area of the peripheral groove 4 in the insert 3 is preferably made at least equal to the cross-sectional area of the opening 2.

In order to propel a weft thread through the assembly 52, the pressure chamber 8 is intermittently placed in communication with the passage 68, 71 through the nozzle by means of a valve which includes a reciprocable sleeve 9 which is disposed within and is guided by the axial circular cylindrical bore 3*a* in the insert 3.

The sleeve 9 has a radially inwardly extending projection 76 intermediate its ends, such projection 76 tapering radially inwardly in an axially rearward direction and mating with a similarly shaped shoulder 77 located at the junction between the circular cylindrical nozzle portion 72 and the externally tapered region 67. The projection 76 and the shoulder 77 form the above-referred to valve. The portion 75 of the axial bore through the sleeve 9 forwardly of shoulder 76 somewhat exceeds in diameter the outer diameter of the portion 72 of the nozzle disposed within it, so as to present a narrow annular passage 78 between the confronting surfaces of portions 72 and 75.

The sleeve 9 is normally biased in a forward direction (to the left in FIGS. 1 and 2) to cause the projection 76 sealingly to engage the shoulder 77, thereby to shut off communication through passage 78 between the pressure chamber 8 and the space 79 within the rear end of sleeve 9 outwardly of the rear portion 79 of the nozzle. When the valve is opened, weft-propelling fluid emerges at high speed through passage 78, passes rearwardly along the outside of portion 67 of the nozzle, and propels rearwardly a weft strand which issues from the nozzle.

In order to bias the sleeve 9 in the forward (left) direction, the rear end of such sleeve is fixedly connected to a radially disposed disc 10 (FIG. 1) which is mounted for reciprocation axially within a bore 14 in the jacket 13. Disc 10 is constantly urged forwardly by an elongated annular resilient element 11 having its forward end portion telescoped over an axially directed annular flange 10*a* integral with disc 10, and its rear end mounted in a forwardly facing annular groove 11*a* in a cover plate 12. The cover plate 12 is secured to the outer jacket 13 of the overall assembly 51 by a threaded connection 80 therebetween, as shown. Connection 80 permits the biasing force exerted by element 11 upon the sleeve 9 to be suitably adjusted. Rotation of the disc 10 relative to the jacket 13 is prevented by a stud 81 which is screwed into one of the tapped holes 19, the rear end of the stud 81 projecting through a hole 82 through the disc 10, as shown in FIG. 1.

To recapitulate, when the shoulder 77 is moved axially rearwardly away from the projection 76 (i.e., away from the position shown in FIGS. 1–2) by fluid pressure pulses applied to the chamber 8, the fluid in the chamber 8 is propelled rearwardly through the annular passage 78 between the sleeve 9 and the portion 72 of the nozzle, so that such fluid can serve to rearwardly project a weft thread which at that time extends axially through the nozzle passage 68, 71. The bias exerted upon sleeve 9 by resilient member 11 may be overcome, thereby to open the valve formed by projection 76 and shoulder 77, may be overcome in a conventional manner by periodic pressure pulses applied to the chamber 8, e.g., in the general manner described in U.S. Pat. No. 2,998,029, issued Aug. 29, 1961.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a nozzle assembly for a hydraulic jet loom, an annular housing having front and rear end surfaces transverse to its axis and a radial opening extending through the annular wall of the housing intermediate said front and rear end surfaces thereof for admitting a weft-propelling liquid, an annular insert having a hollow interior, the insert being disposed within the housing coaxially thereof, the insert having a peripheral annular recess confronting and in communication with the radial opening in the housing, a tubular nozzle having a plate-like flange at its forward end, the nozzle having a central passage therethrough adapted for the rearward propulsion of a weft extending axially therethrough, the tubular nozzle extending rearwardly into the hollow interior of the insert coaxially thereof, the radially inner rear surface of the flange and the radially inner front surface of the insert being axially spaced apart and defining between them an annular pressure chamber disposed radially outwardly of the passage in the nozzle, conduit means for selectively connecting the pressure chamber to the rear end portion of the outer peripheral surface of the nozzle to communicate with and to propel rearwardly the weft thread extending through the passage in the nozzle, and valve means interposed in said conduit means selectively closing off and opening said conduit means, the improved arrangement for reducing turbulence in the flow of hydraulic pressure pulses between the radial opening in the housing and the pressure chamber, wherein the nozzle and the insert are so positioned that the pressure chamber is axially aligned with the peripheral recess in the insert, and wherein the conduit means comprises an even number of bores extending axially forwardly through the insert from the front wall of the peripheral recess in the insert to the front surface of the insert to provide fluid communication between the peripheral recess and the pressure chamber, the number of such axial bores being at least equal to 4.

2. An assembly as defined in claim 1, in which the radial opening through the wall of the housing extends along a first transverse axis, and in which the axial bores in the insert are distributed around the insert in symmetrical relation to the said first transverse axis.

3. An assembly as defined in claim 1, in which the axial dimension of the peripheral recess in the insert is at least as large as the diameter of the radial opening in the housing.

4. An assembly as defined in claim 1, in which the cross-sectional area of the peripheral recess is at least as large as the cross-sectional area of the radial opening in the housing.

5. An assembly as defined in claim 1, in which the cross-sectional area of the radial opening in the housing is larger than the sum of the cross-sectional areas of the axial bores in the insert.

* * * * *